US006550395B1

(12) United States Patent
Carvalho

(10) Patent No.: US 6,550,395 B1
(45) Date of Patent: Apr. 22, 2003

(54) CONSTRUCTIVE DISPOSAL IN A STABILIZER FOR A RAILWAY TRUCK

(75) Inventor: Harão Marcelo de Oliveira Carvalho, Sio Luis (BR)

(73) Assignee: Compagnie Vale do Rio Doce, Santa Luzia-Minas Gerais (BR)

( * ) Notice: Subject to any disclaimer, the term of this patent is extended or adjusted under 35 U.S.C. 154(b) by 0 days.

(21) Appl. No.: 10/095,288

(22) Filed: Mar. 11, 2002

(30) Foreign Application Priority Data

Dec. 28, 2001 (BR) ..... 8103263 U

(51) Int. Cl.[7] ..... B61F 3/00
(52) U.S. Cl. ..... 105/194
(58) Field of Search ..... 105/157.1, 165, 105/167, 172, 182.1, 194, 206.1, 206.2, 190.1, 208, 209, 190.2

(56) References Cited

U.S. PATENT DOCUMENTS 173,919 A * 2/1876 Doherer ..... 105/209
1,071,694 A * 9/1913 Brooks ..... 105/190.2
1,167,148 A * 1/1916 Bush ..... 105/194
1,229,708 A * 6/1917 Bravi ..... 105/194
1,517,535 A * 12/1924 Cornwall ..... 105/194
1,570,563 A * 1/1926 Glaenzer ..... 105/190.1
2,231,195 A * 2/1941 Piron ..... 105/194
2,748,722 A * 6/1956 Williams ..... 105/194

* cited by examiner

*Primary Examiner*—Mark T. Le
(74) *Attorney, Agent, or Firm*—Katten Muchin Zavis Rosenman

(57) ABSTRACT

A stabilizer for a railway truck has pairs of inverted "J" metallic profiles that are longitudinally attached to the ends of the respective sides of the railway truck. The front ends of the "J" metallic profiles are being interconnected and rigidly conformed to each another by a tubular bar transversally located in front of the front wheels and behind the back wheels of the railway truck, thus providing stability and squaring to the truck as a whole in relation to the railway tracks.

3 Claims, 2 Drawing Sheets

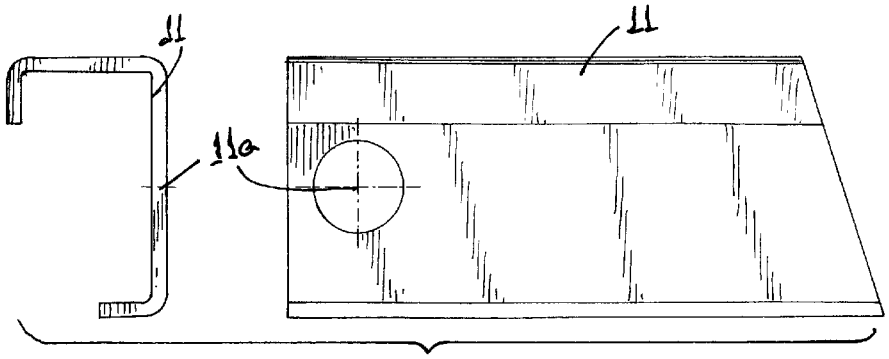
FIG.-3
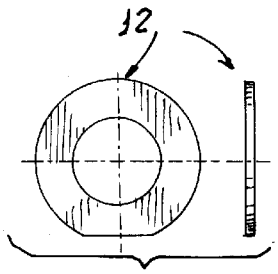
FIG.-4
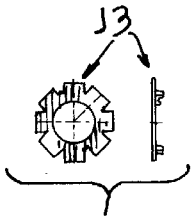
FIG.-5
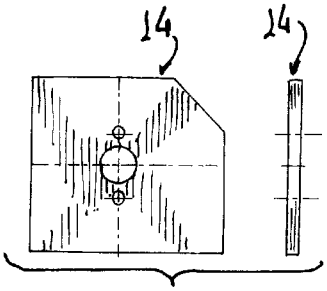
FIG.-6
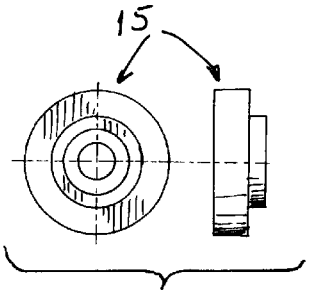
FIG.-7
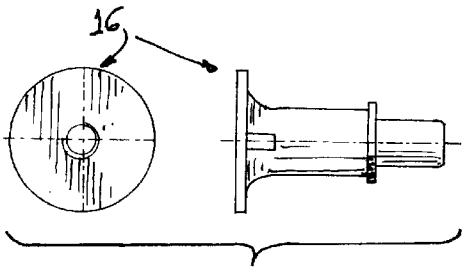
FIG.-8
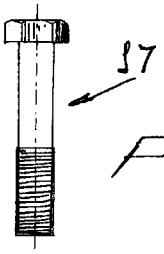
FIG.-9
FIG.-10
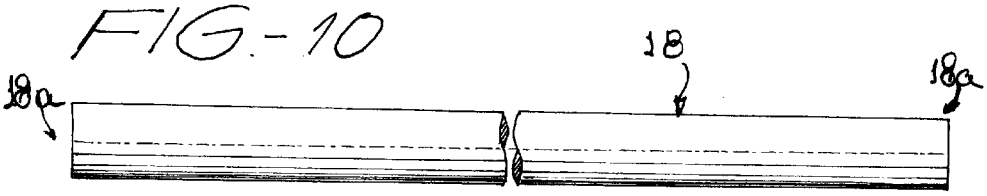

CONSTRUCTIVE DISPOSAL IN A STABILIZER FOR A RAILWAY TRUCK

FIELD OF THE INVENTION

The present specification is related to a constructive disposal in a stabilizer for a railway truck and, more specifically, a device that allows for the squaring of the railway truck, in order to assure a better and greater wheel stability of the latter whenever railway trains get into and go out of curves along the tracks.

BACKGROUND OF THE INVENTION

As is known by those skilled in the art, when no squaring or aligning means for railway trucks in railway trains is used, there would often be problems of fine flange and scaling in the car wheels, the premature machining of these wheels being required, thus reducing the useful life of the latter. At the same time, the non-use of squaring means would cause the tracks to wear out, through the emergence of fissures on the surface that would move towards the core of the railhead, subjecting same to scaling that, when not detected in time, hampers the integrity of the track, causing same to be precociously abraded, what would reduce its useful life.

SUMMARY OF THE INVENTION

To minimize these problems of lack of stability and high stress between the wheels and the main line, a set of two bars crossly positioned in the lower part of the truck was used to interconnect the sides of the trucks, thus allowing the squaring of the latter and improving the performance of the wheels.

With this solution, a longer useful life both of the wheels and the main line could be attained.

Despite the fact that this solution has increased the useful life of the wheels and the main line (tracks) satisfactorily, it has brought about a structural problem in that it gives rise the risk of total loss of the equipment in situations of direct mechanical impact.

Due to the fact of being located under the truck of the railway train, this set of crossed bars is extremely vulnerable to shocks, impacts and even the total loss of the same in the event the train derails.

It is therefore one of the objects of the present invention to provide a constructive disposal in a stabilizer for a railway truck that further increases the useful life of railway trains, more particularly their wheels and trucks, by minimizing the surface wear thereof.

Another object of the present invention is to provide a constructive disposal in a stabilizer for a railway truck that reduces the wear of the main line, consequently increasing its useful life and reducing the risks of accident due to imperfections along the main line.

Another object of the present invention is to provide a constructive disposal in a stabilizer for a railway truck that increases the stability of the railway train as a whole, mainly when same gets into and goes out of curves along the main line.

These and other objects and advantages of the present invention are attained by a constructive disposal in a stabilizer for a railway truck comprised of pairs of inverted "J" metallic profiles, which are longitudinally attached to the ends of the respective sides of the railway truck, the front ends of such metallic profiles being interconnected and rigidly conformed to each other by a corresponding tubular bar transversally positioned in the front of the front wheels and behind the back wheels of the truck, providing stability and squaring of the truck as a whole in relation to the tracks.

BRIEF DESCRIPTION OF THE DRAWINGS

The present invention will be described below with reference to the accompanying drawings, in which:

FIGS. 3 through 8 represent front and side views of the parts that make out the stabilizer for a railway truck in question;

FIG. 9 represents an elevation front view of the stud that attaches the tubular bar to the metallic profiles that in turn are attached to the truck of the railway train; and FIG. 10 represents a partial front view of the stabilizing tubular bar that makes out,the stabilizer for a railway truck.

Detailed Invention of the Drawings

Figure 1:
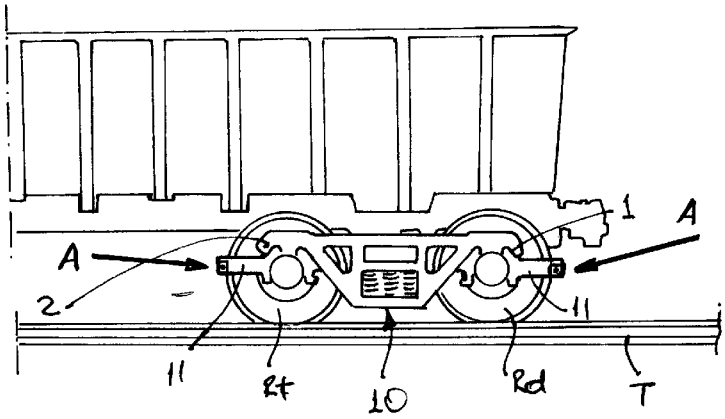
FIG. 1 represents a partial and schematic side view of part of a railway car or wagon wherein one of the trucks of the latter is shown and the positioning of the stabilizer for a railway truck is indicated by arrows "A"

In accordance with these illustrations, the constructive disposal in a stabilizer for a railway truck object of the present invention is comprised of a pair of inverted "J" metallic profiles 11, which are longitudinally attached to the front and back ends 1 and 2 of the respective sides 3 of the railway truck 10, see FIG. 1; the free ends of such metallic profiles 11 being provided with a through-hole 11*a*, see FIG. 3, through which the ends 18*a* of a tubular bar 18 that keeps said sides 3 of the truck 10 rigidly interconnected and conformed to each other are attached.

Figure 2:
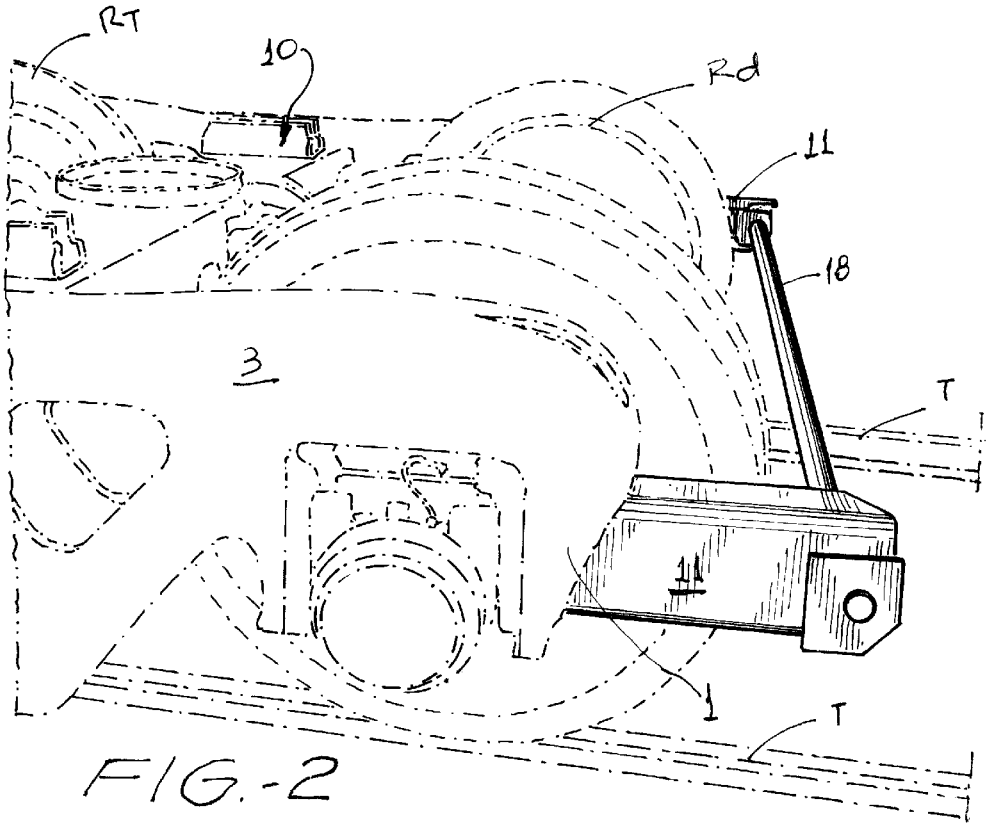
FIG. 2 represents an extended detail of part of a railway truck, shown in dotted line, to show the parts that make out the novel stabilizer for a railway truck.

As can be seen in FIGS. 1 and 2, said stabilizing bar is located in front of the front wheels Rd and behind the back wheels Rt of the truck 10, providing stability and squaring to the truck 10 as a whole in relation to the tracks T.

The end 18*a* of each tubular bar 18 passes through the hole 11*a* and is attached to the respective metallic profile 11, through a set of spacing parts, such as washers 12, 13; axial retainers in the shape of metallic plates 14; guiding bushings 15 and 16, and anchoring bolt 17, as illustrated in FIGS. 3 through 9.

Although a preferred structural configuration has been described and illustrated, it should be pointed out that structural changes as well as of components are possible and attainable without departing from the scope of the present invention.

What is claimed is:

1. A stabilizer for a railway truck, said truck having front wheels and back wheels on opposite sides of said truck, said stabilizer comprising:

a first pair of channels having J-shape cross-sectional profiles attached to said railway truck on opposite sides of the railway truck and having first ends that are connected to each other by a first tubular bar transversally located in front of the front wheels of the railway truck; and a second pair of channels having J-shape cross-sectional profiles attached to said railway truck on opposite sides of the railway truck and having second ends that are connected to each other by a second tubular bar and behind the back wheels of the railway truck, thus providing stability and squaring to the railway truck as a whole in relation to tracks upon which said railway truck rides.

2. A stabilizer for a railway truck in accordance with claim 1, wherein the first and second tubular bars each have opposing free ends, and wherein the first and second ends of the first and second pairs of channels are provided with through holes through which the opposing free ends of the first and second tubular bars that keep said sides of the railway truck rigidly interconnected and conformed to each other are attached.

3. A stabilizer for a railway truck in accordance with claim 2, wherein, each of the free ends of each of the tubular bars passes through the hole in a respective one of the channels.

* * * * *